US011284486B2

(12) United States Patent
Ye et al.

(10) Patent No.: US 11,284,486 B2
(45) Date of Patent: Mar. 22, 2022

(54) LIGHTING APPARATUS

(71) Applicant: XIAMEN LEEDARSON LIGHTING CO., LTD, Fujian (CN)

(72) Inventors: Hemu Ye, Fujian (CN); Wei Liu, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/075,664

(22) Filed: Oct. 20, 2020

(65) Prior Publication Data

US 2021/0120643 A1 Apr. 22, 2021

(30) Foreign Application Priority Data

Oct. 22, 2019 (CN) ..... 201911007935.1
Oct. 22, 2019 (CN) ..... 201921780686.5

(51) Int. Cl.

| | |
|---|---|
| ***H05B 45/20*** | (2020.01) |
| ***H05B 45/325*** | (2020.01) |
| ***H05B 45/345*** | (2020.01) |
| ***H05B 45/46*** | (2020.01) |
| *F21Y 115/10* | (2016.01) |

(52) U.S. Cl.

CPC ..... *H05B 45/20* (2020.01); *H05B 45/325* (2020.01); *H05B 45/345* (2020.01); *H05B 45/46* (2020.01); *F21Y 2115/10* (2016.08)

(58) Field of Classification Search

CPC ..... H05B 45/00; H05B 45/20; H05B 45/32; H05B 45/325; H05B 45/345; H05B 45/46; H05B 47/00; F21Y 2115/10

See application file for complete search history.

(56) References Cited

U.S. PATENT DOCUMENTS

2009/0251071 A1* 10/2009 Gater ..... H05B 45/395 315/297
2015/0116379 A1* 4/2015 Lim ..... G09G 3/342 345/691

* cited by examiner

*Primary Examiner* — Jimmy T Vu
(74) *Attorney, Agent, or Firm* — Chun-Ming Shih; Lanway IPR Services

(57) ABSTRACT

A lighting apparatus includes a first LED module, a second LED module, a third LED module, a constant current generator, a first switch, a third switch and a driver. The constant current generator is used for generating a constant current according to a major PWM signal. The first LED module and the third LED module are connected in parallel and share the constant current. The constant current is adjusted by changing a major duty ratio of the major PWM signal. The driver is used for generating the major PWM signal, a first PWM signal and a third PWM signal. The first color temperature profile, the second color temperature profile and the third color temperature profile have different spectrum distributions.

20 Claims, 11 Drawing Sheets

14
LED1
LED2
LED3
Q1
Q2
Q3
PWM2
PWM3
PWM4
R10
R11
R12

LIGHTING APPARATUS

FIELD

The present invention is related to a lighting apparatus, and more particularly related to a lighting apparatus with parameter adjustment.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

People look forward a light device to be conveniently and stably adjusted for its optical parameters. For example, people may need to change a color temperature to appear warmer or colder.

It is beneficial to find a better way to achieve such goal with a low cost and high reliability.

SUMMARY

In some embodiments, a lighting apparatus includes a first LED module, a second LED module, a third LED module, a constant current generator, a first switch, a third switch and a driver.

The first LED module emits light with a first color temperature profile.

The second LED module emits light with a second color temperature profile.

The third LED module emits light with a third color temperature profile.

Specifically, the first LED module, the second LED module and the third LED module may include multiple LED chips. Different LED modules may have different LED chips for emitting lights of different optical parameters, including color temperature. The color temperature is usually within a range.

In some embodiments, the first LED module emits light within a color temperature range between 1800K-4000K, the second LED module emits light within a color temperature range between 2200K-5000K, and the third LED module emits light within a color temperature range between 3000K to 6500K. The color temperature range and its corresponding distribution on different frequency segments are combined and referred as the color temperature profile.

The second color temperature profile has a color temperature range with a portion overlapping the first color temperature profile and the third color temperature profile. By mixing light outputs of the first LED module and the second LED module, a warmer light output is obtained. By mixing light outputs of the second LED module and the third LED module, a cold color temperature is obtained.

In some embodiments, the second LED module may be used as a base light and is kept the same intensity while changing the intensities of the first LED module and the third LED module to render a required output light. Such method provides a stable and comfortable light output.

When the overall light intensity is to be changed, the second LED module is adjusted to lower or to increase its intensity.

The driver is controlled with a pre-stored setting, a remote control, an external command wireless received from a mobile device or a server, or a manual switch to determine the first PWM signal, the second PWM signal, the third PWM signal and the major PWM signal.

The major PWM signal is used for adjusting an overall light intensity. The first PWM signal and the third PWM signal are adjusted to change a mixed color temperature range for a required mixed color temperature effect.

The constant current generator provides a constant current shared by the first LED module and the third LED module. In some embodiments, the second LED module also shares the same constant current. By setting the first PWM signal, the second PWM signal, and the third PWM signal, the constant current is kept the same while supplying to the first LED module, the second LED module and the third LED module at different timing alternatively.

PWM refers to Pulse Width Modulation. In PWM design, a duty ratio, which is associated to an alternating turn-on and turn-off signal, is used for determining an accumulated strength of current supply over a time period.

The driver contains an integrated chip that receives a setting corresponding to duty ratios for the first PWM signal, the second PWM signal, the third PWM signal and the major PWM signal.

The constant current generator is used for generating a constant current according to a major PWM signal according to a predetermined setting, an external command or a manual switch.

The first LED module and the third LED module are connected in parallel and share the constant current.

The constant current is adjusted by changing a major duty ratio of the major PWM signal.

The first switch is connected between the constant current generator and the first LED module.

The third switch is connected between the constant current generator and the third LED module.

The driver is used for generating the major PWM signal, a first PWM signal and a third PWM signal.

The first switch is turned on according to the first PWM signal for conducting the constant current generator and the first LED module.

The third switch is turned on according to the third PWM signal for conducting the constant current generator and the third LED module.

By using the first switch and the third switch, the constant current is directed to either the first LED module or the third LED module depending on whether their corresponding switches are turned on or not, which is determined by the first PWM signal and the third PWM signal.

As mentioned above, the second LED module may share the same constant current in some embodiments, there may be a second switch for the second LED module.

These switches may be made of transistor devices that receives a control voltage to turn on or turn off a conductive path.

The first color temperature profile, the second color temperature profile and the third color temperature profile have different spectrum distributions.

In some embodiments, the second LED module is supplied with a second constant current source to receive a second constant current.

In some embodiments, the second constant current source adjusts the second constant current according to the major PWM signal.

In some embodiments, the second LED module is connected with the first LED module and the third LED module in parallel to share the constant current.

In some embodiments, the second LED module is connected to the constant current generator via a second switch.

The second switch is turned on according to a second PWM signal generated by the driver.

In some embodiments, the first color temperature profile has color temperatures in a first boundary range.

The second color temperature profile has color temperatures in a second boundary range.

The third color temperature profile has color temperatures in a third boundary range. The first boundary range, e.g. 1800K-4000K is lower than the second boundary range, e.g. 2200K-5000K.

The second boundary range, e.g. 2200K-5000K is smaller than the third boundary range, e.g. 3000K-6500K.

In some embodiments, the constant current generator stores energy with an inductor to generate the constant current. Specifically, the constant current is provided by a stored energy of the inductor in a magnetic form to make the output current stable and constant.

In some embodiments, the constant current generator stores energy with a capacitor for generate the constant current. Specifically, the constant current is provided by a stored energy of the capacitor to make the output current stable and constant.

In some embodiments, a rectifier is used for converting an alternating current to an input direct current voltage. For example, the rectifier may have a bridge circuit for converting a 110V/220V alternating power source to a direct current power.

The direct current power is then converted again with a DC-DC converting to increase its voltage to drive the first LED module, the second LED module and the third LED module that are designed to operate under a high voltage low current environment to increase efficiency.

The constant current generator converts the input direct current voltage to a higher output direct current voltage for the constant current. Specifically, it is a DC-DC converting.

In some embodiments, the input current voltage is less than 60V.

In some embodiments, the input current voltage is less than 24V.

In some embodiments, the first LED module and the third LED module are not turned on at the same time.

In some embodiments, a mixed color temperature is obtained by mixing lights of the first LED module, the second LED module and the third LED module.

In some embodiments, the second LED module is kept turning on as a base color temperature.

In some embodiments, a mixed color temperature is kept the same when the first PWM signal is changed.

In some embodiments, a mixed color temperature is varied when the first PWM signal is changed.

In some embodiments, the mixed color temperature is moved to a warmer color temperature when an overall intensity of the lighting apparatus is lowered down.

In some embodiments, multiple color LED modules are controlled by the driver to generate a mixed color.

In some embodiments, the driver adjusts the first PWM signal and the third PWM signal to adjust a mixed spectrum for optimizing a color rendering effect for an object type. For example, the first color temperature profile may have a portion of required light components optimizing for rendering meat, plastic units, diamonds or certain object types to appear more attractively. The portion may be mixed with another portion in the third LED module with a specific ratio to obtain an optimized visual effect.

The driver may receive an external command or a setting from a manual switch to choose an object type and its associated mixed light output requirements and determine corresponding first PWM signal, second PWM signal, third PWM signal to mix required parameters.

In some embodiments, a manual switch controls the driver to determine the first PWM signal and the third PWM signal. For example, the manual switch may a sliding switch, a dip switch or other types of switch mounted on a surface of the lighting apparatus for user to manually adjust its status.

DETAILED DESCRIPTION

Figure 7:
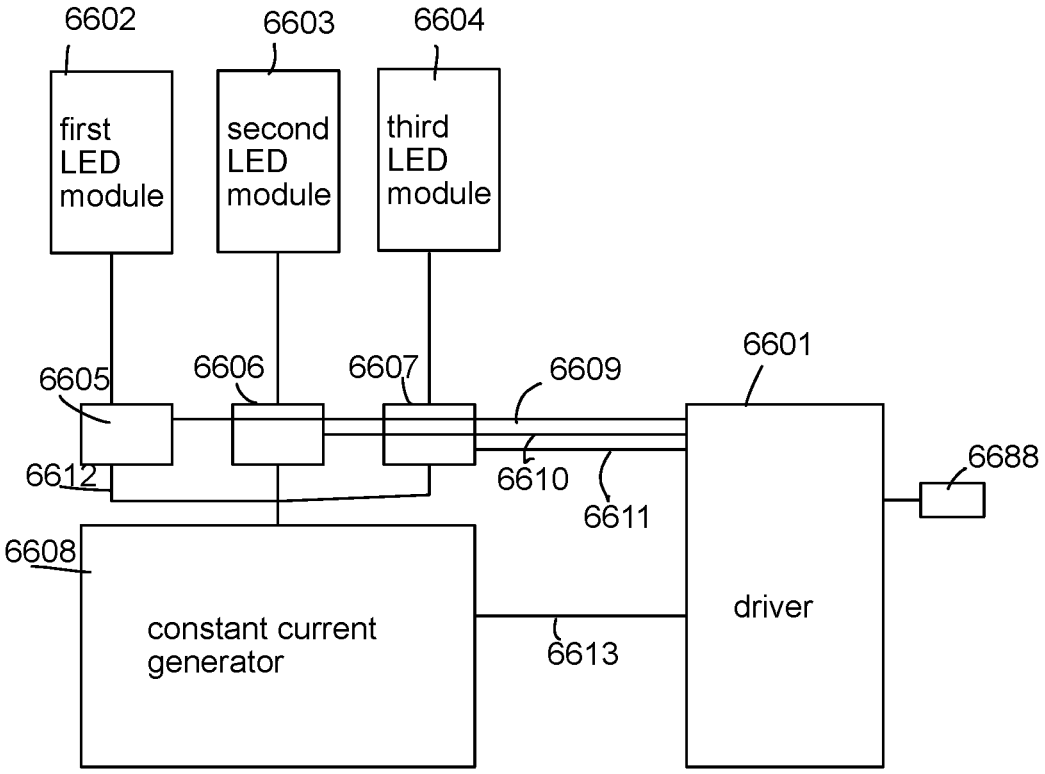
FIG. 7 shows an embodiment.

In FIG. 7, a lighting apparatus includes a first LED module 6602, a second LED module 6603, a third LED module 6604, a constant current generator 6608, a first switch 6605, a third switch 6607 and a driver 6601.

The first LED module 6602 emits light with a first color temperature profile.

The second LED module 6603 emits light with a second color temperature profile.

The third LED module 6604 emits light with a third color temperature profile.

Specifically, the first LED module, the second LED module and the third LED module may include multiple LED chips. Different LED modules may have different LED chips for emitting lights of different optical parameters, including color temperature. The color temperature is usually within a range.

In some embodiments, the first LED module emits light within a color temperature range between 1800K-4000K, the second LED module emits light within a color temperature range between 2200K-5000K, and the third LED module emits light within a color temperature range between 3000K to 6500K. The color temperature range and its corresponding distribution on different frequency segments are combined and referred as the color temperature profile.

Figure 8:
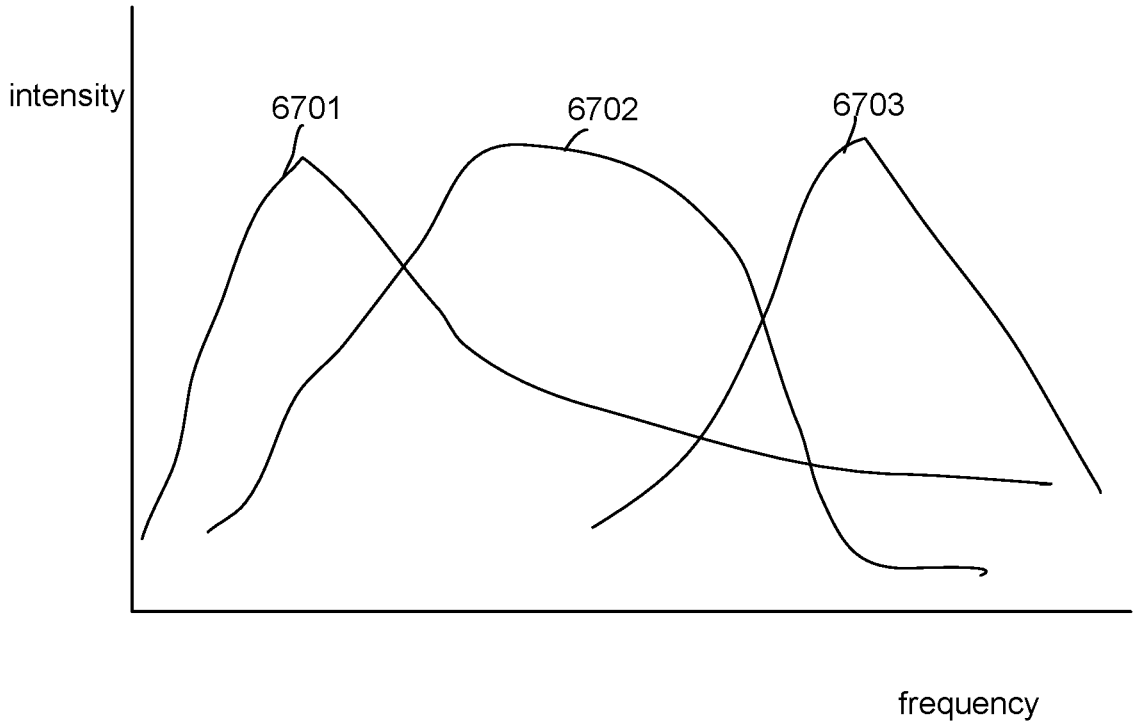
FIG. 8 shows color temperature profile examples.

Please see FIG. 8. The first color temperature profile 6701, the second color temperature profile 6702, and the third color temperature profile 6703 may have different range corresponding to light output intensity distribution at different frequency segments.

The second color temperature profile has a color temperature range with a portion overlapping the first color temperature profile and the third color temperature profile. By mixing light outputs of the first LED module and the second LED module, a warmer light output is obtained. By mixing light outputs of the second LED module and the third LED module, a cold color temperature is obtained.

In some embodiments, the second LED module may be used as a base light and is kept the same intensity while changing the intensities of the first LED module and the third LED module to render a required output light. Such method provides a stable and comfortable light output.

When the overall light intensity is to be changed, the second LED module is adjusted to lower or to increase its intensity.

The driver is controlled with a pre-stored setting, a remote control, an external command wireless received from a mobile device or a server, or a manual switch to determine the first PWM signal, the second PWM signal, the third PWM signal and the major PWM signal.

The major PWM signal is used for adjusting an overall light intensity. The first PWM signal and the third PWM signal are adjusted to change a mixed color temperature range for a required mixed color temperature effect.

The constant current generator provides a constant current shared by the first LED module and the third LED module. In some embodiments, the second LED module also shares the same constant current. By setting the first PWM signal, the second PWM signal, and the third PWM signal, the constant current is kept the same while supplying to the first LED module, the second LED module and the third LED module at different timing alternatively.

PWM refers to Pulse Width Modulation. In PWM design, a duty ratio, which is associated to an alternating turn-on and turn-off signal, is used for determining an accumulated strength of current supply over a time period.

The driver contains an integrated chip that receives a setting corresponding to duty ratios for the first PWM signal, the second PWM signal, the third PWM signal and the major PWM signal.

The constant current generator is used for generating a constant current according to a major PWM signal according to a predetermined setting, an external command or a manual switch.

In FIG. 7, the first LED module 6602 and the third LED module 6604 are connected in parallel and share the constant current 6612.

The constant current 6612 is adjusted by changing a major duty ratio of the major PWM signal 6613.

The first switch 6605 is connected between the constant current generator 6608 and the first LED module 6602.

The third switch 6607 is connected between the constant current generator 6608 and the third LED module 6604.

The driver 6601 is used for generating the major PWM signal 6613, a first PWM signal 6609 and a third PWM signal 6611.

The first switch is turned on according to the first PWM signal for conducting the constant current generator and the first LED module.

The third switch is turned on according to the third PWM signal for conducting the constant current generator and the third LED module.

By using the first switch and the third switch, the constant current is directed to either the first LED module or the third LED module depending on whether their corresponding switches are turned on or not, which is determined by the first PWM signal and the third PWM signal.

As mentioned above, the second LED module 6603 may share the same constant current in some embodiments, there may be a second switch 6606 for the second LED module activated with a second switch 6606 according to a second PWM signal 6610.

These switches may be made of transistor devices that receives a control voltage to turn on or turn off a conductive path.

The first color temperature profile, the second color temperature profile and the third color temperature profile have different spectrum distributions.

Figure 11:
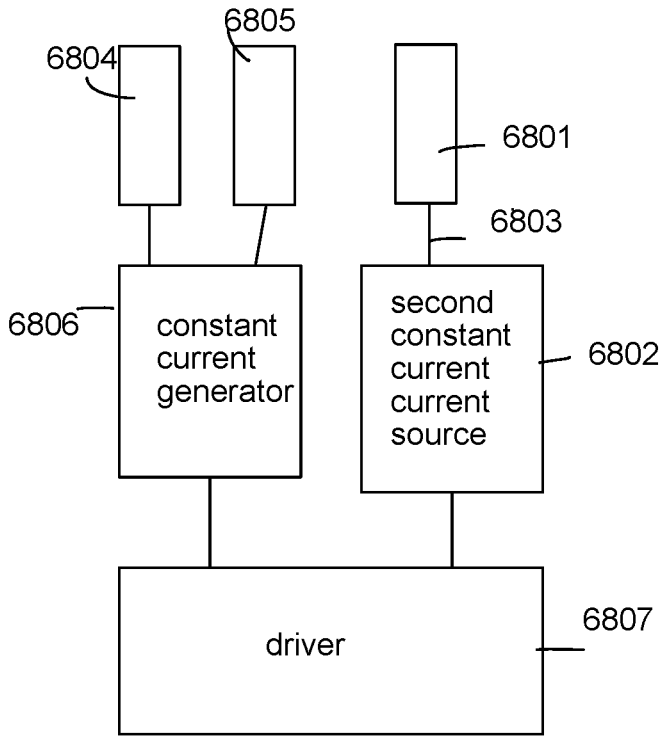
FIG. 11 shows another embodiment.

In FIG. 11, the second LED module 6801 is supplied with a second constant current source 6802 to receive a second constant current. The first LED module 6804 and the second LED module 6805 received constant current from the constant current generator 6806 controlled by a driver 6807.

In some embodiments, the second constant current source adjusts the second constant current according to the major PWM signal.

In some embodiments, the second LED module is connected with the first LED module and the third LED module in parallel to share the constant current.

In some embodiments, the second LED module is connected to the constant current generator via a second switch.

The second switch is turned on according to a second PWM signal generated by the driver.

In some embodiments, the first color temperature profile has color temperatures in a first boundary range.

The second color temperature profile has color temperatures in a second boundary range.

The third color temperature profile has color temperatures in a third boundary range.

The first boundary range, e.g. 1800K-4000K is lower than the second boundary range, e.g. 2200K-5000K.

The second boundary range, e.g. 2200K-5000K is smaller than the third boundary range, e.g. 3000K-6500K.

Figure 9:
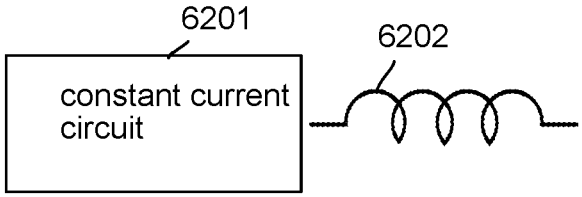
FIG. 9 shows using an inductor for storing energy.

In FIG. 9, the constant current generator has a constant current circuit 6201 stores energy with an inductor 6202 to generate the constant current. Specifically, the constant current is provided by a stored energy of the inductor in a magnetic form to make the output current stable and constant.

Figure 10:
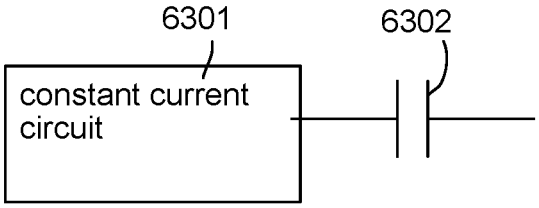
FIG. 10 shows using a capacitor for storing energy.

In FIG. 10, the constant current generator has a constant current circuit 6301 stores energy with a capacitor 6302 for generate the constant current. Specifically, the constant current is provided by a stored energy of the capacitor to make the output current stable and constant.

There are various constant current circuit designs known to persons skilled in the art and may be used here and explanation thereto is omitted for brevity.

In some embodiments, a rectifier is used for converting an alternating current to an input direct current voltage. For example, the rectifier may have a bridge circuit for converting a 110V/220V alternating power source to a direct current power.

The direct current power is then converted again with a DC-DC converting to increase its voltage to drive the first LED module, the second LED module and the third LED module that are designed to operate under a high voltage low current environment to increase efficiency.

The constant current generator converts the input direct current voltage to a higher output direct current voltage for the constant current. Specifically, it is a DC-DC converting.

In some embodiments, the input current voltage is less than 60V.

In some embodiments, the input current voltage is less than 24V.

In some embodiments, the first LED module and the third LED module are not turned on at the same time.

In some embodiments, a mixed color temperature is obtained by mixing lights of the first LED module, the second LED module and the third LED module.

In some embodiments, the second LED module is kept turning on as a base color temperature.

In some embodiments, a mixed color temperature is kept the same when the first PWM signal is changed.

In some embodiments, a mixed color temperature is varied when the first PWM signal is changed.

In some embodiments, the mixed color temperature is moved to a warmer color temperature when an overall intensity of the lighting apparatus is lowered down.

In some embodiments, multiple color LED modules are controlled by the driver to generate a mixed color.

In some embodiments, the driver adjusts the first PWM signal and the third PWM signal to adjust a mixed spectrum for optimizing a color rendering effect for an object type. For example, the first color temperature profile may have a portion of required light components optimizing for rendering meat, plastic units, diamonds or certain object types to appear more attractively. The portion may be mixed with another portion in the third LED module with a specific ratio to obtain an optimized visual effect.

The driver may receive an external command or a setting from a manual switch to choose an object type and its associated mixed light output requirements and determine corresponding first PWM signal, second PWM signal, third PWM signal to mix required parameters.

In FIG. 7, a manual switch 6688 controls the driver 6601 to determine the first PWM signal and the third PWM signal. For example, the manual switch may a sliding switch, a dip switch or other types of switch mounted on a surface of the lighting apparatus for user to manually adjust its status.

Figure 1:
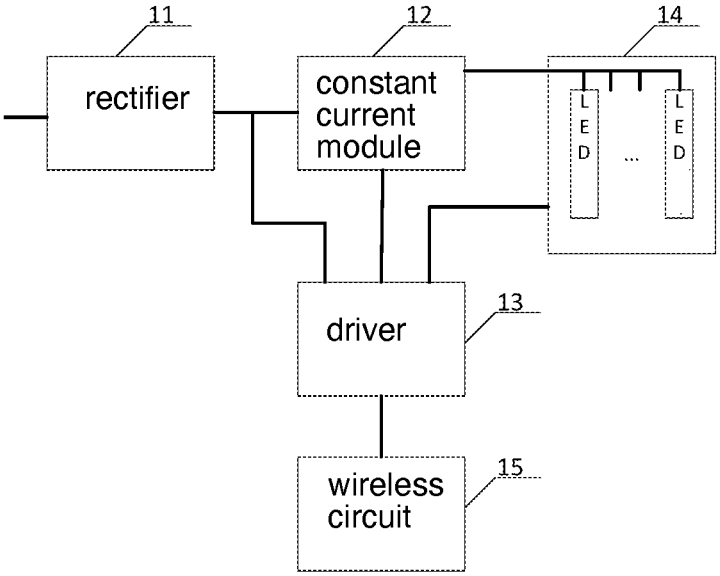
FIG. 1 illustrates a circuit block diagram of an embodiment.

Please refer to FIG. 1. FIG. 1 shows a circuit diagram of a lighting apparatus embodiment.

In FIG. 1, a rectifier 11 converts an alternating current source, e.g. a 110V/220V alternating power source to a direct current power. The constant current module 12 contains the constant current generator and/or other components mentioned above. Multiple LED modules 14 are connected in parallel as mentioned above. A driver 13 receives a command or a setting to generate PWM signals to control the constant current module 12 and the LED modules 14.

Figure 2:
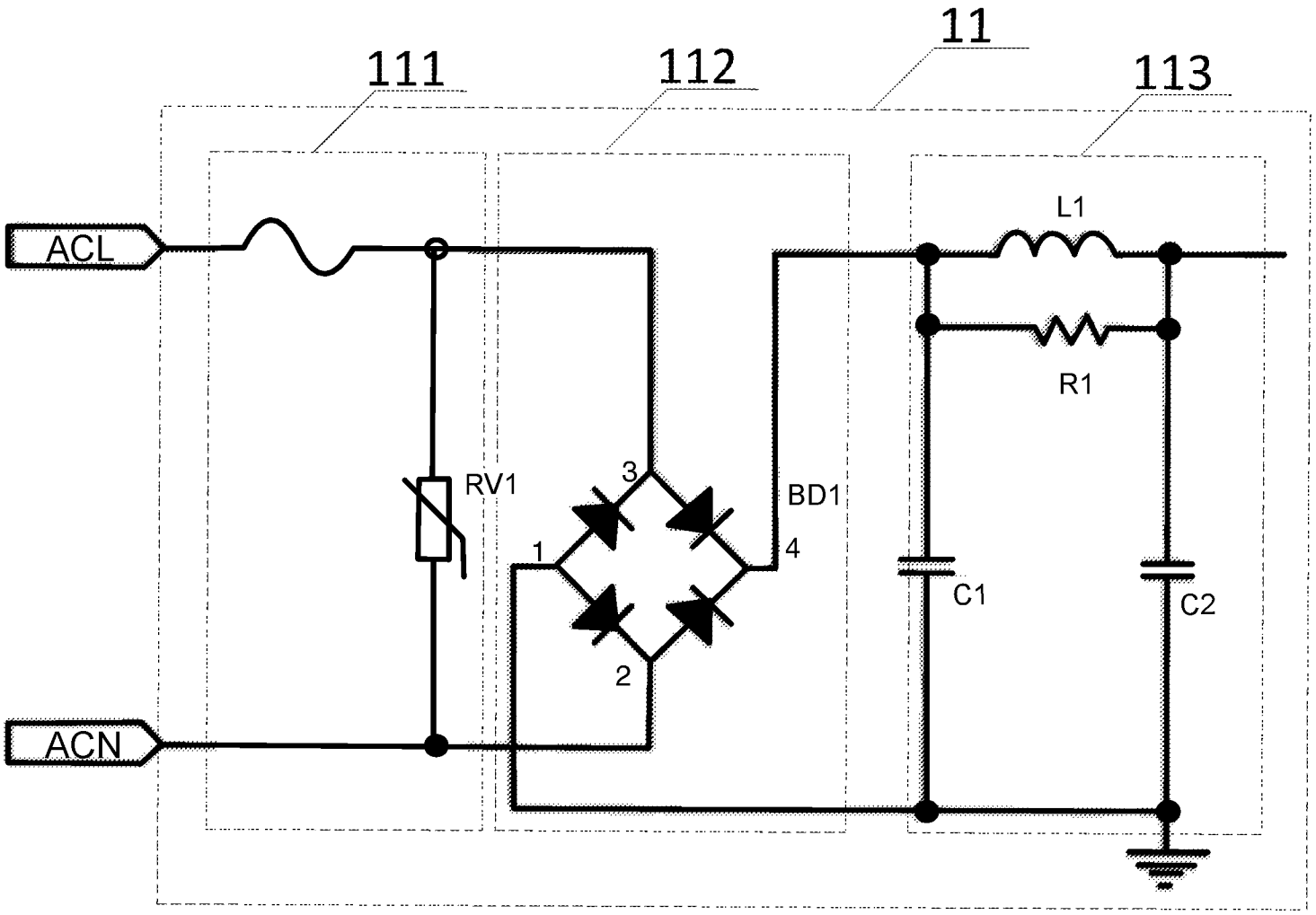
FIG. 2 illustrates a rectifier circuit diagram in an example.

FIG. 2 shows a rectifier 11 diagram with a bridge circuit and other components to rectifying an input power source. In FIG. 2, there is a protection circuit 111, a rectifier circuit 112, and a filter 113 for filtering the output.

Figure 3:
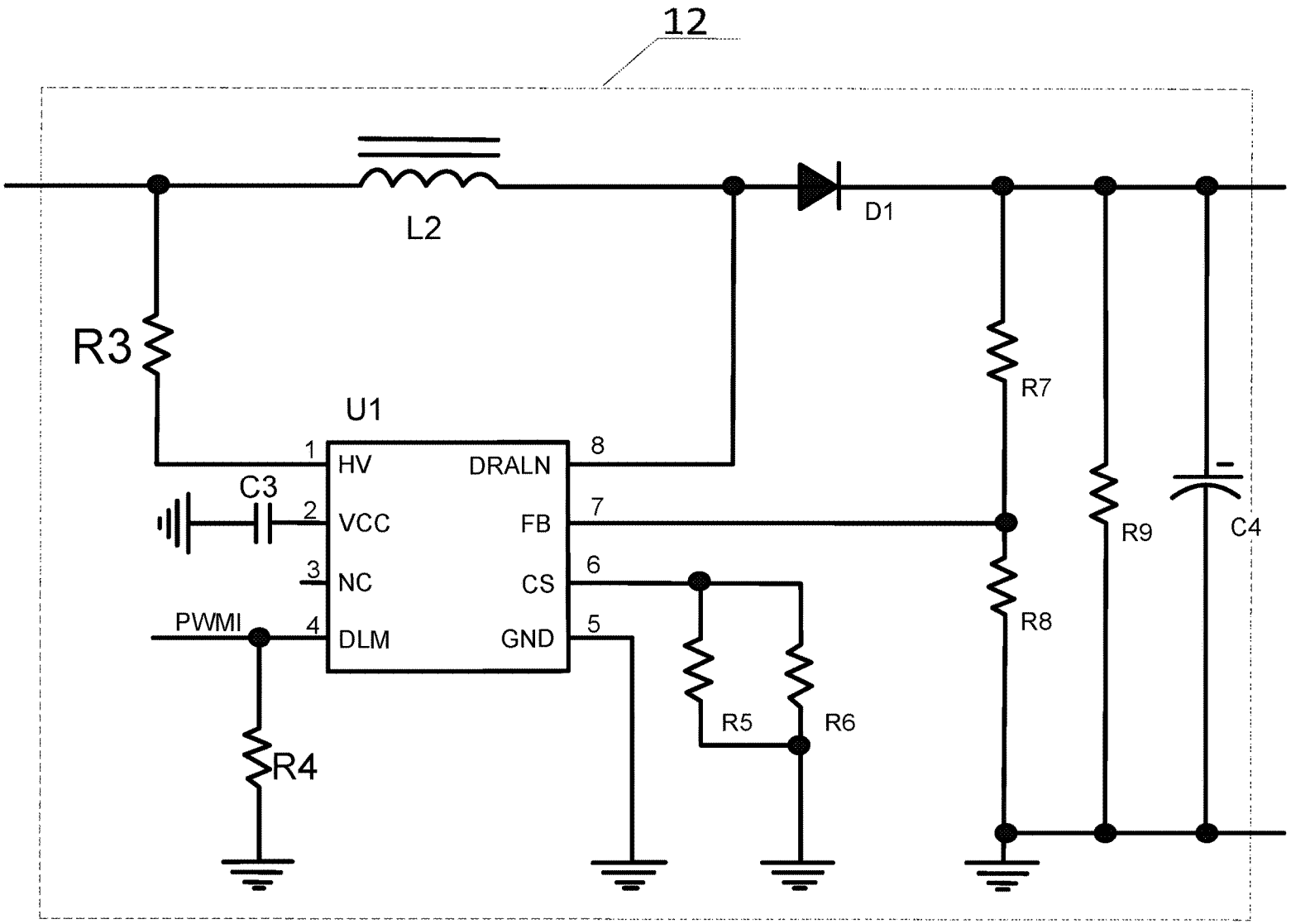
FIG. 3 illustrates a constant current generator example.

FIG. 3 shows a constant current module 12. The constant current module 12 has an integrated chip U1 using a capacitor C4 to store energy and for generating a constant current according to a PWM 1 signal.

Figure 4:
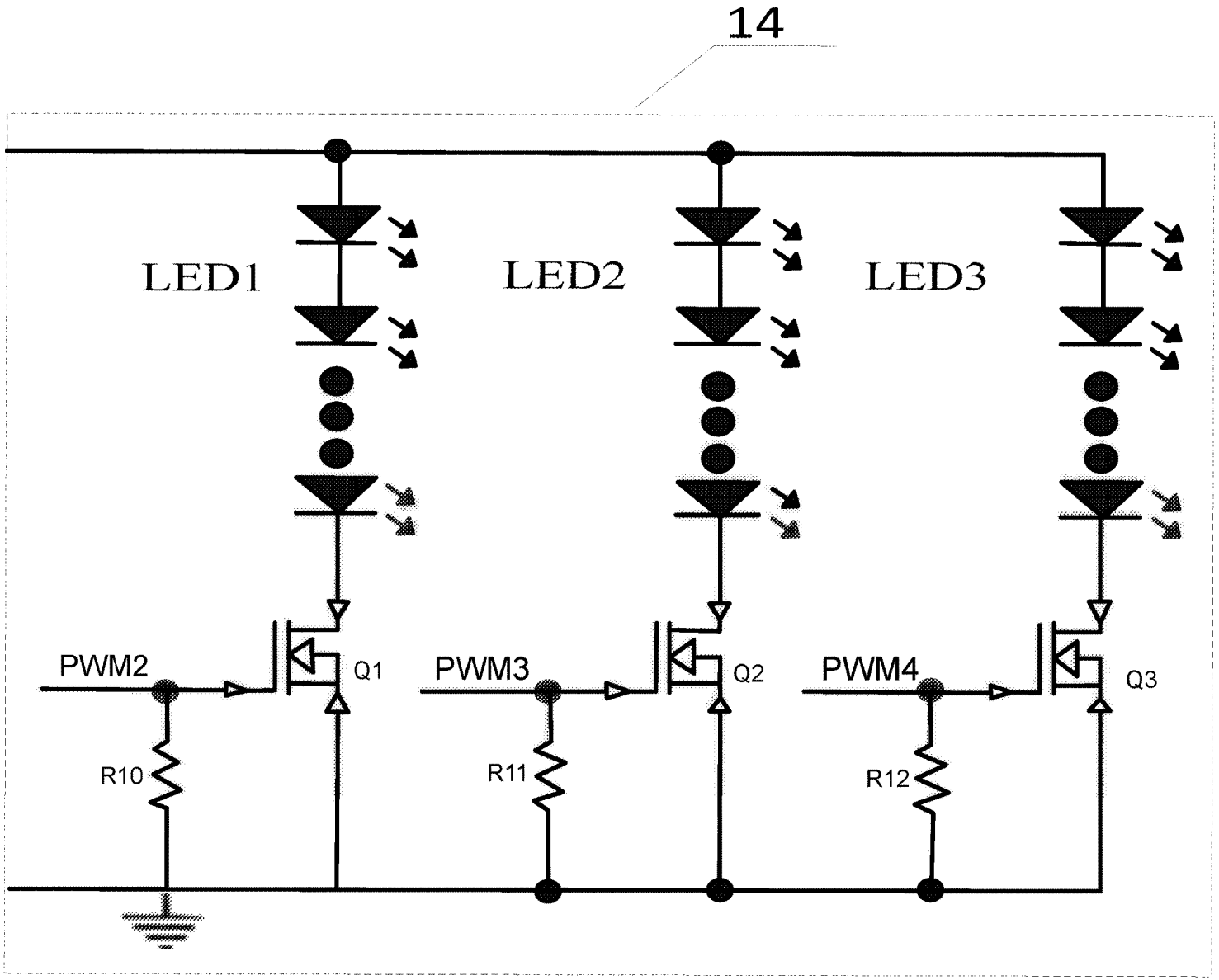
FIG. 4 illustrates multiple LED modules connected in parallel.

FIG. 4 shows three LED modules, LED 1, LED 2, LED 3 are connected in parallel with three switches Q1, Q2, Q3 controlled by a first PWM signal PWM2, a second PWM signal PWM3 and a third PWM signal PWM4.

Figure 5:
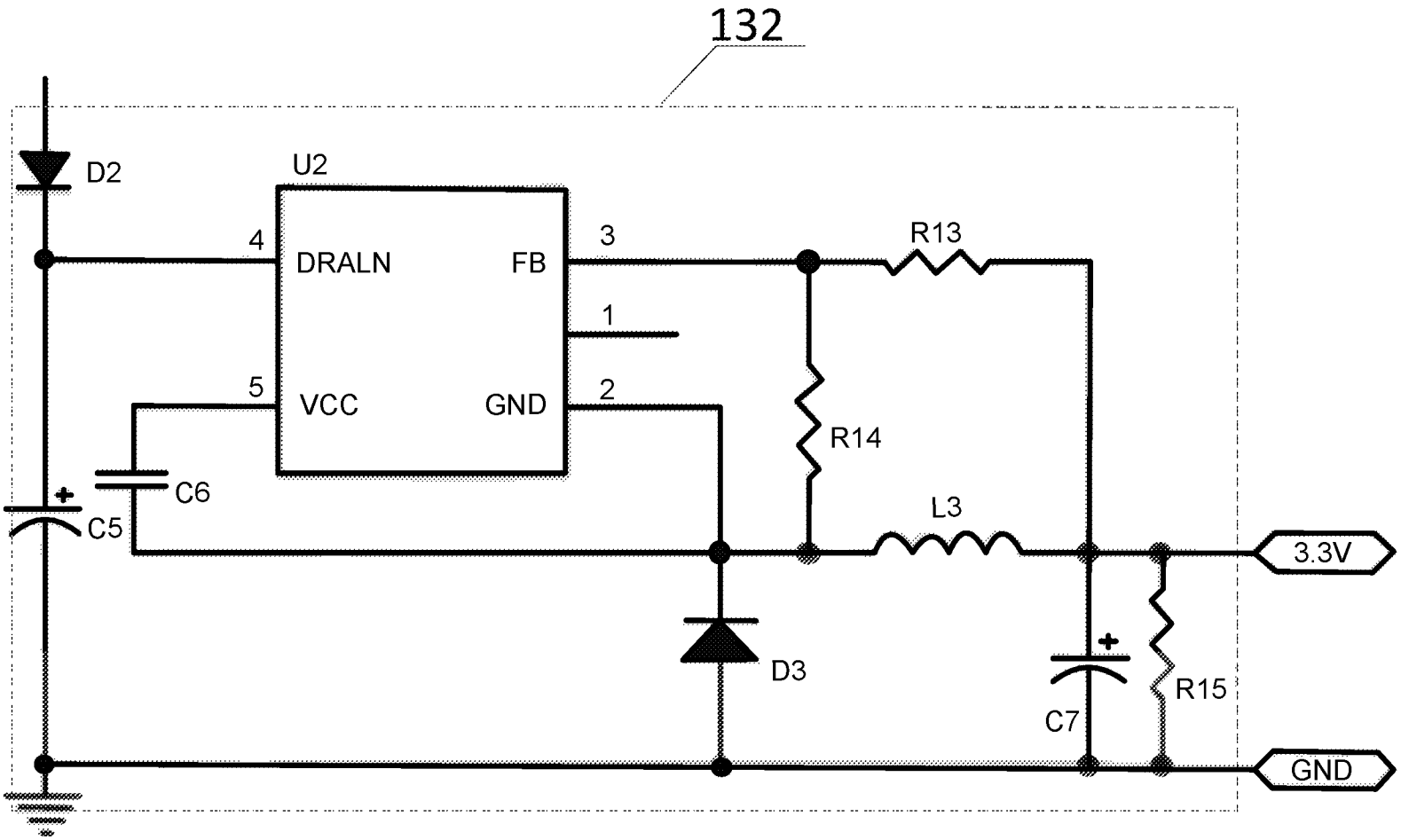
FIG. 5 illustrates a power circuit example.

FIG. 5 shows a power unit 132 in the driver 13. The power unit 132 uses a common power integrated chip U2 to generate the constant current and to increase voltage level.

A buck-boost structure current circuit may be applied in this embodiment.

Figure 6:
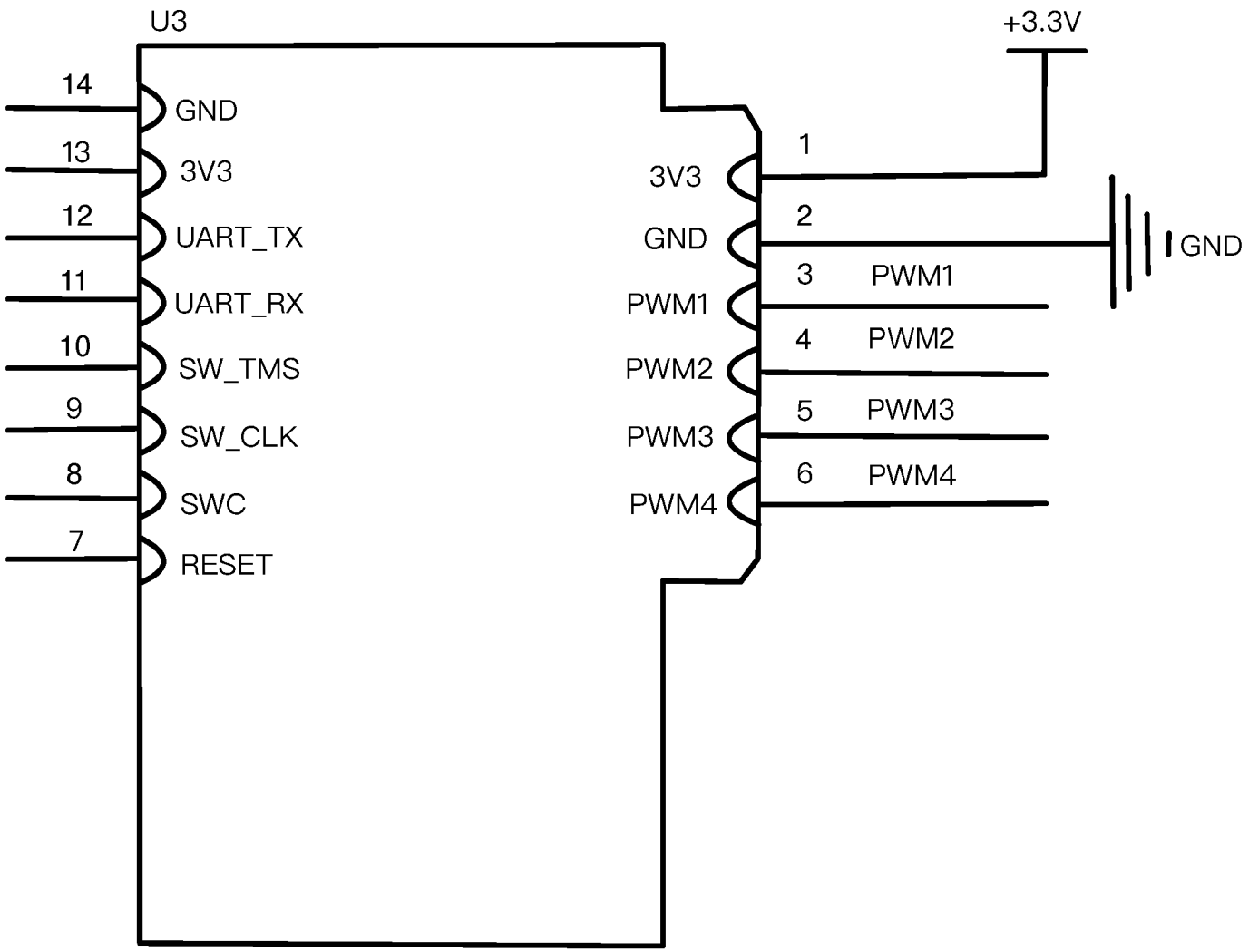
FIG. 6 illustrates a driver for generating multiple PWM signals.

FIG. 6 shows a driver for generating the major PWM signal PWM1, the first PWM signal PWM2, the second PWM signal PWM3, and the third PWM signal PWM4.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a first LED module with a first color temperature profile;

a second LED module with a second color temperature profile;

a third LED module with a third color temperature profile;

a constant current generator for generating a constant current according to a major PWM signal, wherein the first LED module and the third LED module are connected in parallel and share the constant current, the constant current is adjusted by changing a major duty ratio of the major PWM signal;

a first switch connected between the constant current generator and the first LED module;

a third switch connected between the constant current generator and the third LED module; and a driver for generating the major PWM signal, a first PWM signal and a third PWM signal, wherein the first switch is turned on according to the first PWM signal for conducting the constant current generator and the first LED module, the third switch is turned on according to the third PWM signal for conducting the constant current generator and the third LED module, the first color temperature profile, the second color temperature profile and the third color temperature profile have different spectrum distributions.

2. The lighting apparatus of claim 1, wherein the second LED module is supplied with a second constant current source to receive a second constant current.

3. The lighting apparatus of claim 2, wherein the second constant current source adjusts the second constant current according to the major PWM signal.

4. The lighting apparatus of claim 1, wherein the second LED module is connected with the first LED module and the third LED module in parallel to share the constant current.

5. The lighting apparatus of claim 4, wherein the second LED module is connected to the constant current generator via a second switch, the second switch is turned on according to a second PWM signal generated by the driver.

6. The lighting apparatus of claim 1, wherein the first color temperature profile has color temperatures in a first boundary range, the second color temperature profile has color temperatures in a second boundary range, the third color temperature profile has color temperatures in a third boundary range, the first boundary range is lower than the second boundary range, the second boundary range is smaller than the third boundary range.

7. The lighting apparatus of claim 1, wherein the constant current generator stores energy with an inductor to generate the constant current.

8. The lighting apparatus of claim 1, wherein the constant current generator stores energy with a capacitor for generate the constant current.

9. The lighting apparatus of claim 1, wherein a rectifier is used for converting an alternating current to an input direct current voltage, the constant current generator converts the input direct current voltage to a higher output direct current voltage for the constant current.

10. The lighting apparatus of claim 9, wherein the input current voltage is less than 60V.

11. The lighting apparatus of claim 10, wherein the input current voltage is less than 24V.

12. The lighting apparatus of claim 1, wherein the first LED module and the third LED module are not turned on at the same time.

13. The lighting apparatus of claim 1, wherein a mixed color temperature is obtained by mixing lights of the first LED module, the second LED module and the third LED module.

14. The lighting apparatus of claim 1, wherein the second LED module is kept turning on as a base color temperature.

15. The lighting apparatus of claim 1, wherein a mixed color temperature is kept the same when the first PWM signal is changed.

16. The lighting apparatus of claim 1, wherein a mixed color temperature is varied when the first PWM signal is changed.

17. The lighting apparatus of claim 16, wherein the mixed color temperature is moved to a warmer color temperature when an overall intensity of the lighting apparatus is lowered down.

18. The lighting apparatus of claim 1, wherein multiple color LED modules are controlled by the driver to generate a mixed color.

19. The lighting apparatus of claim 1, wherein the driver adjusts the first PWM signal and the third PWM signal to adjust a mixed spectrum for optimizing a color rendering effect for an object type.

20. The lighting apparatus of claim 1, wherein a manual switch controls the driver to determine the first PWM signal and the third PWM signal.

* * * * *